United States Patent [19]

Beattie

[11] Patent Number: 4,683,732

[45] Date of Patent: Aug. 4, 1987

[54] LIVE BOLT ASSEMBLY FOR SAFE DOOR

[75] Inventor: Patrick J. Beattie, Henrietta, N.Y.

[73] Assignee: John D. Brush & Co., Inc., Rochester, N.Y.

[21] Appl. No.: 888,517

[22] Filed: Jul. 21, 1986

Related U.S. Application Data

[63] Continuation of Ser. No. 712,810, Mar. 15, 1985, abandoned, which is a continuation-in-part of Ser. No. 520,438, Aug. 4, 1983, abandoned.

[51] Int. Cl.[4] ..... E05B 63/14

[52] U.S. Cl. ..... 70/118; 109/59 R; 292/3 L; 292/40; 292/68; 292/161

[58] Field of Search ..... 70/118, 119, 114, 115, 70/116, 1.5; 109/58, 59 R, 63.5; 292/7, 32, 33, 34, 35, 36, 37, 38, 39, 40, 41, 42, 43, 68, 161

[56] References Cited

U.S. PATENT DOCUMENTS

| | | | |
|---|---|---|---|
| 1,280,993 | 10/1918 | Hammer | 292/159 |
| 1,468,245 | 9/1923 | McDermott | 70/1.5 |
| 2,956,525 | 10/1960 | Blauvelt | 109/59 |
| 3,063,282 | 11/1962 | Aytes | 70/119 |
| 3,371,628 | 3/1968 | McClellan | 109/59 |
| 4,142,747 | 3/1979 | Beck | 292/37 |

FOREIGN PATENT DOCUMENTS

| | | | |
|---|---|---|---|
| 84311 | 12/1895 | Fed. Rep. of Germany | 109/59 |
| 565931 | 8/1975 | Switzerland | 109/58 |
| 256064 | 8/1926 | United Kingdom | 292/7 |

*Primary Examiner*—Robert L. Wolfe

*Attorney, Agent, or Firm*—Stonebraker, Shepard & Stephens

[57] ABSTRACT

My safe door live bolt assembly 10 is operated by a handle spindle 38 and uses a pair of identical castings 15 that each include a pair of live bolts 16 interconnected by a bracket 17. Each casting 15 has a single connecting rod 30 extending from bracket 17, and the inner ends of connecting rods 30 connect to a T-bar 35 that overlies the inward facing sides of connecting rods 30 and is secured to handle spindle 38 for operating live bolts 16. Slide brackets 12 secured to inner safe wall 13 guide live bolts 16 in their sliding motion and afford bracing for live bolt connecting brackets 17. Although each bracket 17 has a lock projection 20, only one of these interacts with a combination lock 25.

33 Claims, 2 Drawing Figures

LIVE BOLT ASSEMBLY FOR SAFE DOOR

RELATED APPLICATIONS

This application is a continuation of parent application Ser. No. 712,810, filed Mar. 15, 1985, and now abandoned entitled LIVE BOLT ASSEMBLY FOR SAFE DOOR, and abandoned upon the filing of this continuation application, which parent application was a continuation-in-part of grandparent application Ser. No. 520,438, filed Aug. 4, 1983, and now abandoned entitled LIVE BOLT ASSEMBLY FOR SAFE DOOR, and abandoned upon the filing of the parent application.

BACKGROUND

Safe doors generally use a single handle to operate several live bolts spaced around the periphery of the door. The handle turns a set of cranks, and connecting rods extend from the cranks to each of the live bolts. The assembly must also interact with a combination lock so that it can be operated only when the lock is open. Such live bolt assemblies have cost at least several dollars to make because of the many parts that must be fabricated and assembled.

I have discovered a way of greatly reducing the cost of a safe door live bolt assembly. My construction reduces the number of parts, simplifies their fabrication, and leads to quick and inexpensive assembly. My live bolt assembly is also rugged and secure and produces four well-spaced and sturdy live bolts.

SUMMARY OF THE INVENTION

My safe door live bolt assembly is operated by a handle spindle and includes a pair of identical castings. Each of the castings has a pair of live bolts interconnected by a bracket from which extends a single connecting rod and a single lock projection, only one of which interacts with a combination lock. Slide brackets on an inner surface of the door guide the live bolts in sliding motion. A T-bar connected to the handle spindle and connectably fitted over inward facing sides of inner ends of the connecting rods inwardly overlies and operates the connecting rods to make the live bolts slide.

DRAWINGS

FIG. 1 is a partially cutaway elevational view of the inside of a safe door having a preferred embodiment of my live bolt assembly; and FIG. 2 is a cross-section of the safe door of FIG. 1, taken along the line 2—2 thereof.

DETAILED DESCRIPTION

Figure 1:
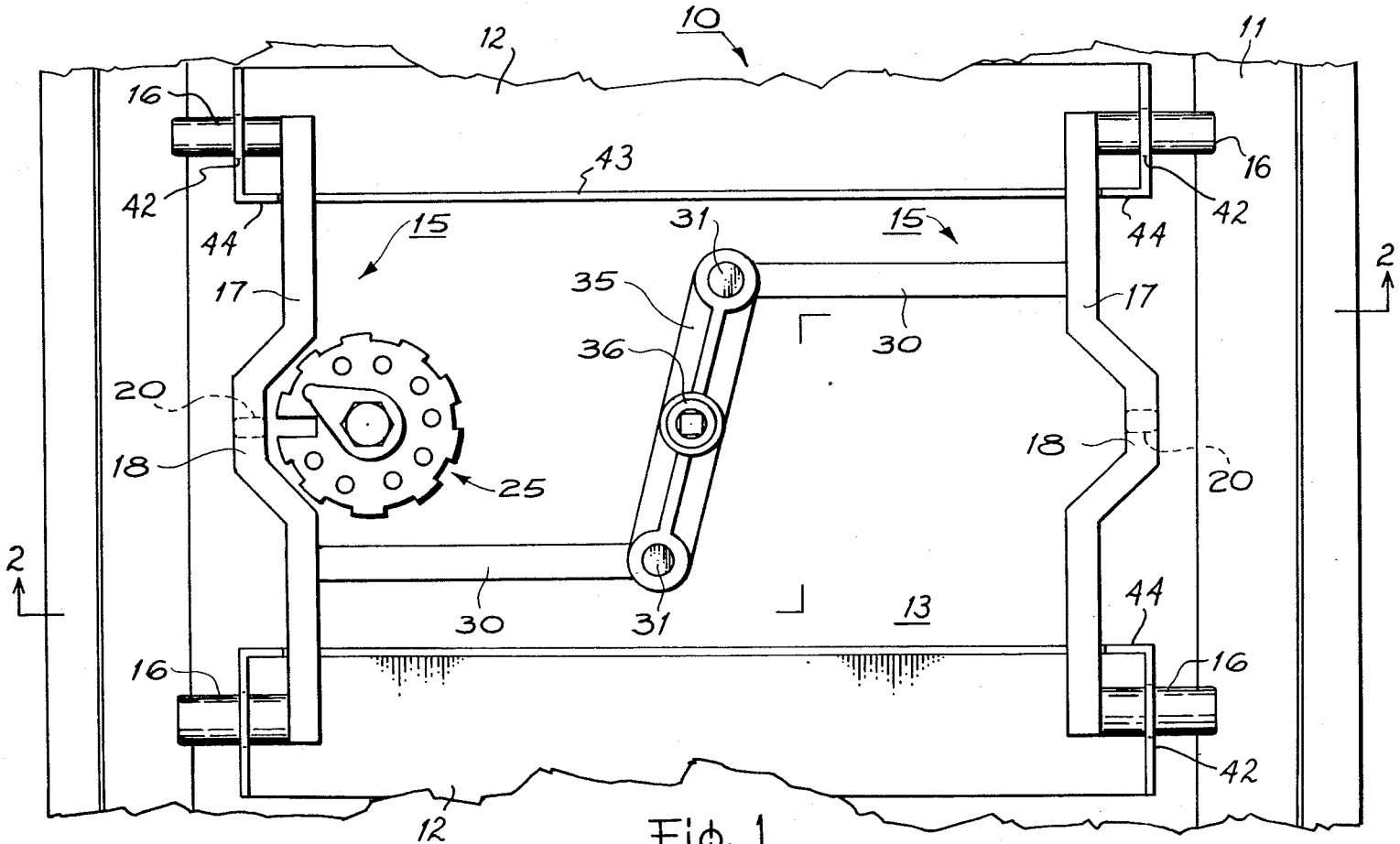
Figure 2:
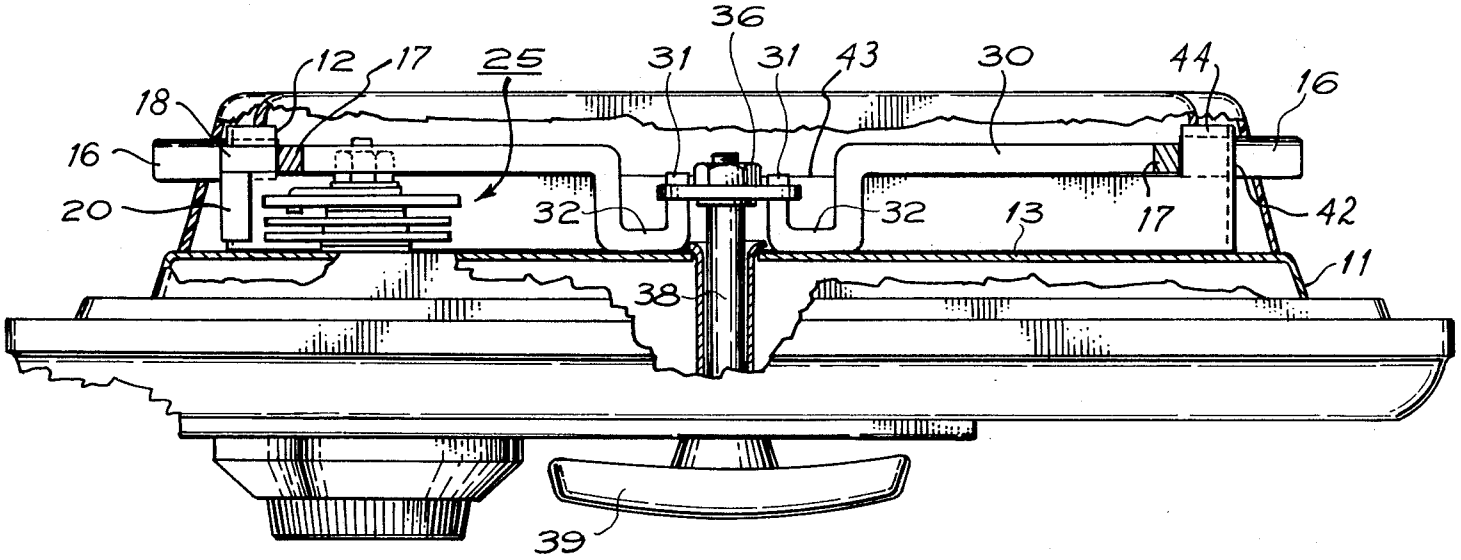

My live bolt assembly 10 uses a pair of identical castings 15 that can be economically made with a single mold. Each casting 15 includes a pair of live bolts 16 that are spaced apart to work at suitable locations on the periphery of safe door 11. Live bolts 16 are interconnected by a bracket 17 that includes a central offset 18 from which a lock projection 20 extends toward an inner wall 13 of door 11 to interact with a combination lock 25. Although each bracket 17 has a lock projection 20, only one of the lock projections 20 interacts with combination lock 25. It is simpler and less expensive to make identical die castings 15, each having a lock projection 20, than to make two different castings. Central offset 18 strengthens bracket 17 against torsional or twisting forces that can be applied by forcing bracket 17 and projection 20 against an unlocked combination lock 25.

Castings 15 each have a connecting rod 30 extending from bracket 17 to a crank pin 31 on the inner end of each connecting rod 30. An offset 32 near crank pin 31 supports each connecting rod 30 for sliding engagement with the inner surface of inner wall 13 of door 11. Crank pins 31 are transverse to connecting rods 30 and live bolts 16 and are engaged by T-bar 35 having end holes to receive crank pins 31. Connecting rods 30 are offset from a center line between the live bolts extending through lock projection 20 and the central offset region 18 of bracket 17. This disposes each connecting rod in an offset but convenient position on opposite sides of handle spindle 38 for interaction with T-bar 35 to operate live bolts 16. A nut 36 secures T-bar 35 to handle spindle 38 so that T-bar 35 turns when handle 39 turns. Rotation of T-bar 35 moves connecting rods 30 and operates live bolts 16 if lock projection 20 is not blocked from movement by combination lock 25.

Crank pins can also be arranged on T-bar 35 to connectably fit with holes arranged on the inner ends of connecting rods 30 to accomplish the same effect shown in the drawings. Either way, however, it is important that T-bar 35 engage the inward facing sides of connecting rods 30 and be spaced from inner wall 13 of safe door 11. This accomplishes two things. First, T-bar 35 traps the inner ends of connecting rods 30 against the safe door inner wall 13 to hold connecting rods 30 in their fit with T-bar 35. Second, if handle spindle 38 is punched through into the interior of the safe by an assault with a punch, T-bar 35 is driven inward with spindle 38 and disconnected from connecting rods 30, which can stay in place, leaving live bolts 16 locked. Otherwise, if connecting rods 30 are driven inward with T-bar 35 as spindle 38 is punched into the safe, this could retract live bolts 16 enough to force open door 11. So securing T-bar 35 inwardly of the inner ends of connecting rod 30 increases the security of the live bolt lock system.

Brackets 12 guide live bolts 16 in sliding motion and also brace brackets 17 against twisting distortion. Preferably, two longitudinal brackets 12 are welded to inner safe wall 13 to extend across the inside of door 11 between opposed pairs of live bolts 16 as illustrated. End regions of each bracket 12 have holes 42 receiving and guiding live bolts 16. Brackets 12 also have bracing edges 43 offset from holes 42 by abutment 44 at each end region of brackets 12. Edges 43 brace and strengthen interconnecting brackets 17, which guide on bracing edges 43 as live bolts 16 slide in and out of holes 42. Abutments 44 offsetting from live bolt hole 42 the region where bracket 17 engages bracing edge 43 afford a bracing lever arm that greatly strengthens live bolts 16 against prying forces tending to twist live bolts 16 on their interconnecting bracket 17. Slide brackets 12 also accomplish this with a simple sheet metal configuration economically welded to inner safe door wall 13.

To assemble assembly 10, it is only necessary to slide live bolts 16 through holes 42 in slide brackets 12 with connecting rods 30 extending toward the central region of door 11. Since castings 15 are identical, they cannot be mistakenly assembled. Offsets 32 near the inner ends of connecting rods 30 support crank pins 31 to extend inward from inner wall 13 of door 11. By fitting the end holes of T-bar 35 over crank pins 31 and securing T-bar 35 to spindle 38 with nut 36, the live bolt assembly is completed.

Crank pins 31 cannot escape from engagement with T-bar 35, and live bolts 16 are postioned in a working sliding engagement in slide brackets 12. One of the lock projections 20 is automatically disposed for interaction with combination lock 25, and the system is ready to work upon turning handle 39. The current expense of fabrication and assembly gives the illustrated embodiment a total manufacturing cost of only one-fifth the cost of a previously used conventional, assembly.

I claim:

1. A safe door live bolt assembly comprising:

a. a pair of slide brackets braced across said door, with opposite end regions of each of said slide brackets having live bolt support holes, and each of said slide brackets having a bracing surface extending in a direction parallel with and offset from a live bolt motion path through said holes; and b. two pairs of live bolts mounted for sliding movement in said support holes, each pair of said live bolts being connected by an interconnecting bracket that engages and slides along said bracing surfaces at a distance from said support holes to provide bracing leverage resisting force applied to pry open said safe door.

2. The live bolt assembly of claim 1 wherein said slide brackets extend horizontally and said interconnecting brackets extend vertically.

3. The live bolt assembly of claim 1 wherein central regions of said interconnecting brackets are offset from a linear path between paired live bolts, and lock projections are mounted on the central offset regions of said interconnecting brackets.

4. The live bolt assembly of claim 1 wherein said slide brackets include stops limiting movement of said interconnecting brackets toward said support holes.

5. The live bolt assembly of claim 1 wherein said bracing surfaces are closer to the outside of said safe door than are axes of said live bolts.

6. The live bolt assembly of claim 1 wherein each of said slide brackets has a base element secured to said safe door, an upstanding element at each opposite end providing said support holes, and an upstanding wall perpendicular to said base and providing said bracing surface.

7. A live bolt assembly for strengthening a safe door, said live bolt assembly comprising:

a. two pairs of live bolts, the live bolts of each pair being joined by an interconnecting bracket movable with said live bolts;

b. a pair of slide brackets bracing and extending between opposite edge regions of said safe door, each end of each of said slide brackets having an upstanding element with a hole for guiding and supporting one of said live bolts for movement outward of said upstanding element; and c. each of said slide brackets having a bracing surface offset from the path of movement of said live bolts in said holes for engaging and supporting said interconnecting brackets in regions spaced inward from said upstanding elements for resisting prying forces tending to bend said live bolts and twist said interconnecting brackets.

8. The live bolt assembly of claim 7 wherein each of said interconnecting brackets has a central offset region with a lock projection.

9. The live bolt assembly of claim 7 wherein each of said slide brackets has an upstanding wall providing said bracing surface.

10. The live bolt assembly of claim 9 wherein said bracing surface is closer to the outside of said safe door than are axes of said live bolts.

11. The live bolt assembly of claim 9 including abutments upstanding from said bracing surface for limiting movement of said interconnecting brackets toward said holes.

12. The live bolt assembly of claim 7 wherein said slide brackets are oriented horizontally and said interconnecting brackets are oriented vertically.

13. A improvement strengthening a live bolt assembly for a safe door, said improvement comprising:

a. live bolts having forward ends that interlock with a safe and rearward ends joined to interconnecting brackets extending between said pairs of said live bolts;

b. slide brackets bracing said safe door and having ends with guide holes supporting said live bolts in regions spaced forward from said rearward ends; and c. said slide brackets having bracing surfaces offset from said live bolts for engaging said interconnecting brackets in regions spaced rearward from said holes so that leverage provided by the engagement of said interconnecting brackets with said bracing surfaces relative to the support of said live bolts in said guide holes braces said forward ends of said live bolts against forces tending to pry open said safe door.

14. The improvement of claim 13 wherein said interconnecting brackets extend vertically between said pairs of live bolts, and said slide brackets extend horizontally across said safe door.

15. The improvement of claim 13 wherein end regions of said bracing surfaces terminate at abutments limiting movement of said interconnecting brackets toward said holes.

16. The improvement of claim 15 wherein said bracing surfaces are closer to the outside of said safe door than are axes of said live bolts.

17. The live bolt assembly of claim 13 wherein each of said interconnecting brackets has a central offset region with a lock projection.

18. The improvement of claim 13 wherein said bracing surfaces of said slide brackets are formed as an edge of a wall of each of said slide brackets perpendicular to a base of each of said slide brackets, and said ends of each of said slide brackets are perpendicular to said base and said wall.

19. A live bolt assembly for a safe door, said live bolt assembly comprising:

a. two pairs of spaced apart live bolts, the live bolts of each pair being joined together by an interconnecting bracket extending between rear regions of said live bolts;

b. a pair of slide brackets braced across said safe door with opposite end regions of each slide bracket having a hole for receiving a forward region of a live bolt in slidable motion; and c. said live bolt pairs being arranged in said supporting holes so that said interconnecting brackets engage and slide along bracing surfaces of said slide brackets in regions spaced rearwardly from said supporting holes for resisting prying forces applied to said forward regions of said live bolts.

20. The live bolt assembly of claim 19 wherein said opposite end regions of said slide brackets are perpendicular to the outside of said safe door.

21. The live bolt assembly of claim 20 wherein said bracing surfaces extend inward from the outside of said safe door by less than said upstanding end regions.

22. The live bolt assembly of claim 19 including abutments arranged at opposite end regions of said bracing surfaces for limiting movement of said interconnecting brackets toward said holes.

23. The live bolt assembly of claim 19 wherein said slide brackets extend horizontally and said interconnecting brackets extend vertically.

24. The live bolt assembly of claim 19 wherein each of said interconnecting brackets has a central offset region with a lock projection.

25. A safe door live bolt assembly operated by a handle spindle turning a T-bar inside said safe door, said assembly including two sets of interconnected live bolts, each set having a connecting rod extending to said T-bar, and said assembly comprising:

a. said live bolt sets being identical and each being formed of a single, integral metal casting that includes a bracket interconnecting said live bolts and has said connecting rod and a lock projection extending from said interconnecting bracket;

b. a pair of slide brackets mounted on an inner surface of said door, each of said slide brackets having a pair of holes arranged for receiving and guiding two of said live bolts in a sliding motion; and c. said slide brackets each having bracing surfaces extending in a direction parallel with the motion of said live bolts in each of said holes, said bracing surfaces being disposed for engaging and bracing said interconnecting brackets in regions spaced in said parallel direction from each of said holes.

26. The assembly of claim 25 wherein each of said slide brackets has said bracing surfaces arranged for bracing said interconnecting brackets of each of said live bolt sets.

27. The assembly of claim 25 wherein said slide brackets extend horizontally across said safe door between laterally opposed live bolts.

28. The assembly of claim 25 wherein central regions of said interconnecting brackets of said live bolt castings are offset from a linear path between said live bolts, and said lock projections are mounted on said central offset regions of said interconnecting brackets.

29. The assembly of claim 28 wherein each of said slide brackets has said bracing surfaces arranged for bracing said interconnecting brackets of each of said live bolt sets.

30. The assembly of claim 29 wherein said slide brackets extend horizontally across said safe door between laterally opposed live bolts.

31. The assembly of claim 25 wherein said bracing surfaces of said slide brackets are offset from the paths of said live bolts in said holes.

32. The assembly of claim 31 wherein each of said bracing surfaces braces a pair of said connecting brackets for laterally opposed live bolts.

33. The assembly of claim 32 wherein said slide brackets extend horizontally across said safe door between laterally opposed live bolts.

* * * * *